US007533953B2

(12) United States Patent
Vladislav et al.

(10) Patent No.: US 7,533,953 B2
(45) Date of Patent: May 19, 2009

(54) METHOD AND APPARATUS FOR COMPENSATING FOR DEFECTIVE NOZZLE IN INKJET IMAGE FORMING APPARATUS

(75) Inventors: Terekhov Vladislav, Suwon-si (KR); Ki-min Kang, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 132 days.

(21) Appl. No.: 11/519,939

(22) Filed: Sep. 13, 2006

(65) Prior Publication Data

US 2007/0085866 A1 Apr. 19, 2007

(30) Foreign Application Priority Data

Oct. 14, 2005 (KR) ..... 10-2005-0096964

(51) Int. Cl.
*B41J 29/38* (2006.01)

(52) U.S. Cl. ..... 347/14; 347/19

(58) Field of Classification Search ..... 347/14
See application file for complete search history.

(56) References Cited

U.S. PATENT DOCUMENTS 6,695,435 B1 * 2/2004 Cheng et al. ..... 347/43
2003/0085950 A1 * 5/2003 Yashima ..... 347/43
2004/0100513 A1 * 5/2004 Kanematsu ..... 347/9
2004/0119766 A1 * 6/2004 Shibata et al. ..... 347/12

FOREIGN PATENT DOCUMENTS

| | | |
|---|---|---|
| JP | 63-256457 | 10/1988 |
| JP | 2004-058284 | 2/2004 |
| JP | 2005-096232 | 4/2005 |
| JP | 2005-096424 | 4/2005 |

* cited by examiner

*Primary Examiner*—Lamson D. Nguyen
*Assistant Examiner*—Brian J Goldberg
(74) *Attorney, Agent, or Firm*—Roylance, Abrams, Berdo & Goodman, LLP

(57) ABSTRACT

A method and apparatus for compensating for a defective nozzle in an inkjet image forming apparatus are provided, in which a defective nozzle of a nozzle unit is detected, ejecting statuses of nozzles of the nozzle unit are checked which eject ink at a compensation position on a printing medium corresponding to the defective nozzle and nozzles of the nozzle unit which eject ink at positions adjacent to the compensation position when the defective nozzle is detected, and at least three pieces of image data to be printed at the compensation position and the adjacent positions are swapped and printed according to the ejecting statuses of the nozzle. Accordingly, the image data are swapped for each other in order to be printed or divided and then printed. Thus, image quality degradation such as a visible white line can be prevented.

23 Claims, 10 Drawing Sheets

METHOD AND APPARATUS FOR COMPENSATING FOR DEFECTIVE NOZZLE IN INKJET IMAGE FORMING APPARATUS

CROSS-REFERENCE TO RELATED PATENT APPLICATIONS

This application claims the benefit under 35 U.S.C. § 112 (a) of Korean Patent Application No. 10-2005-0096964, filed on Oct. 14, 2005, in the Korean Intellectual Property Office, the entire disclosure of which is hereby incorporated by reference.

BACKGROUND OF THE INVENTION

1. Field of the Invention

The present invention relates to an inkjet image forming apparatus. More particularly, the present invention relates to a method and apparatus for compensating for image quality degradation caused by defective nozzles in an inkjet image forming apparatus.

2. Description of the Related Art

An inkjet image forming apparatus forms images by ejecting ink from an inkjet head onto a printing medium. The inkjet head is placed a predetermined distance apart from the printing medium and moves reciprocally in a direction perpendicular to the transferring direction of the printing medium. Such an inkjet image forming apparatus is referred to as a shuttle type inkjet image forming apparatus. An inkjet head of the shuttle type inkjet image forming apparatus includes a nozzle unit on which a plurality of nozzles that eject ink are formed.

Recently, an inkjet head having a nozzle unit with a length corresponding to the width of a printing medium has been used for high-speed printing. An image forming apparatus operating in this way is referred to as a page width inkjet image forming apparatus. An inkjet head of the page width inkjet image forming apparatus is fixed and only a printing medium is transferred. Accordingly, a driving device of the inkjet image forming apparatus is simple and high-speed printing is possible.

FIG. 1 shows printing patterns when a defective nozzle exists in a conventional inkjet image forming apparatus, and FIGS. 2A through 2D are pixel images for explaining a method of compensating for the defective nozzle in the conventional inkjet image forming apparatus.

Referring to FIG. 1, the inkjet image forming apparatus forms an image by spraying ink I from nozzles 82 formed on a nozzle unit 80 onto a printing medium. When a nozzle 84 is defective, a visible unprinted line is generated on the printing medium as shown in FIG. 1. Such an unprinted line is easily visible, and thus affects printing quality.

A method of compensating for deterioration of image quality due to a missing or not working nozzle is disclosed in U.S. Pat. No. 5,581,284. FIGS. 2A through 2D are the same drawings illustrated in FIGS. 3 through 6 of U.S. Pat. No. 5,581,284. Referring to FIGS. 2A through 2D, the defective nozzle indicates a case when a nozzle does not normally eject ink or is missing in the pixel image as the printing medium is moved in the direction of an arrow. When a defective nozzle ejecting mono (that is, black) ink is detected, ink droplets of other colors (for example, cyan, magenta, and yellow) are sequentially ejected to a pixel region 63 to which the defective nozzle should have ejected black ink. That is, the black color can be represented by printing the cyan, magenta, and yellow ink droplets on the same position of the printing medium. The represented black is called process black ("P" in FIG. 2D) or composite black. However, this method is useful to compensate for a defective nozzle ejecting black ink, but does not compensate for detective nozzles ejecting other colors. Moreover, since the nozzles for cyan, magenta, and yellow ink do not operate when only the black color is printed, the process black cannot be formed using other color nozzles. However, when a color image is printed, the nozzles for cyan, magenta, and yellow ink operate, and the compensation cannot be performed. Further, when one of the nozzles used for compensation malfunctions, other colors such as red (yellow+magenta), green (cyan+yellow), or blue (cyan+magenta) color are printed, and thus printing quality is deteriorated. Accordingly, there is a need for an improve way to compensate for a defective nozzle to improve image quality.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide a method and apparatus for compensating for a defective nozzle in an inkjet image forming apparatus to improve printing quality.

Another aspect of exemplary embodiments of the present invention also provides a method and apparatus for compensating for a defective nozzle in an inkjet image forming apparatus, which can compensate for detective nozzles of different colors and minimize the influence of a defective nozzle on image quality.

A further aspect of exemplary embodiments of the present invention also provides a method and apparatus for compensating for a defective nozzle in an inkjet image forming apparatus, which can extend the life span of a printhead.

According to an aspect of exemplary embodiments of the present invention, there is provided a method and apparatus for compensating for a defective nozzle in an inkjet image forming apparatus, in which a defective nozzle of a nozzle unit is detected; ejecting statuses of nozzles of the nozzle unit are checked which eject ink at a compensation position on a printing medium corresponding to the defective nozzle and nozzles of the nozzle unit which eject ink at positions adjacent to the compensation position when the defective nozzle is detected; and at least three pieces of image data to be printed at the compensation position and the adjacent positions are swapped and printed according to the ejecting statuses of the nozzles.

In an exemplary implementation, image information of the image data to be printed at the compensation position and the image data to be printed at the adjacent positions are analyzed. Also, whether there is image data corresponding, to an area to which ink is not ejected among the image data to be printed at the adjacent positions are detected.

In another exemplary implementation, the three pieces of image data that are printed at the compensation position, and a first and a second position among the image data to be printed at the adjacent positions may be swapped for one another according to the ejecting statuses of the nozzles and the analyzed image information. The first position may be one of an upper position and a lower position, rather than the compensation position. Wherein the image data to be printed at the compensation position is shifted to the second position, the image data to be printed at the second position is shifted to the first position, and the image data to be printed at the first position is shifted to the compensation position when image data corresponding to an area to which ink is not ejected is printed at the second position. When the image data cannot be swapped for one another, the image data to be printed at the compensation position may be divided and printed at the compensation position and the adjacent positions.

In still another exemplary implementation, when the image data cannot be swapped for one another, the image data to be printed at the compensation position may be divided and printed at the compensation position and a third position which is one of the adjacent positions. The image data to be printed at the third position may be image data corresponding to an area to which ink is not ejected. The image data to be printed at the compensation position may be printed by ink ejected from two nozzles. Ink of the same color ejected from the defective nozzle may be printed at the third position and ink of a different color ejected from the defective nozzle may be printed at the compensation position.

In a further exemplary implementation, when the image data cannot be swapped for one another, image data to be printed at the compensation position may be divided and printed at the compensation position and the adjacent positions.

In an exemplary implementation, when the image data are swapped for one another, driving data may be swapped and transmitted to respective nozzles of the nozzle unit.

In another exemplary implementation, the adjacent positions of the compensation position may be an upper portion, a lower position, a left position, a left upper position, a left lower position, a right position, a right upper position, and a right lower position.

In still another exemplary implementation, the nozzle unit may have at least a length corresponding to a width of a printing medium.

In a further exemplary implementation, a maintenance operation is performed to return the nozzle unit to a printing standby state when the defective nozzle is detected. Also, a defective nozzle of the nozzle unit is detected after performing the maintenance operation.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
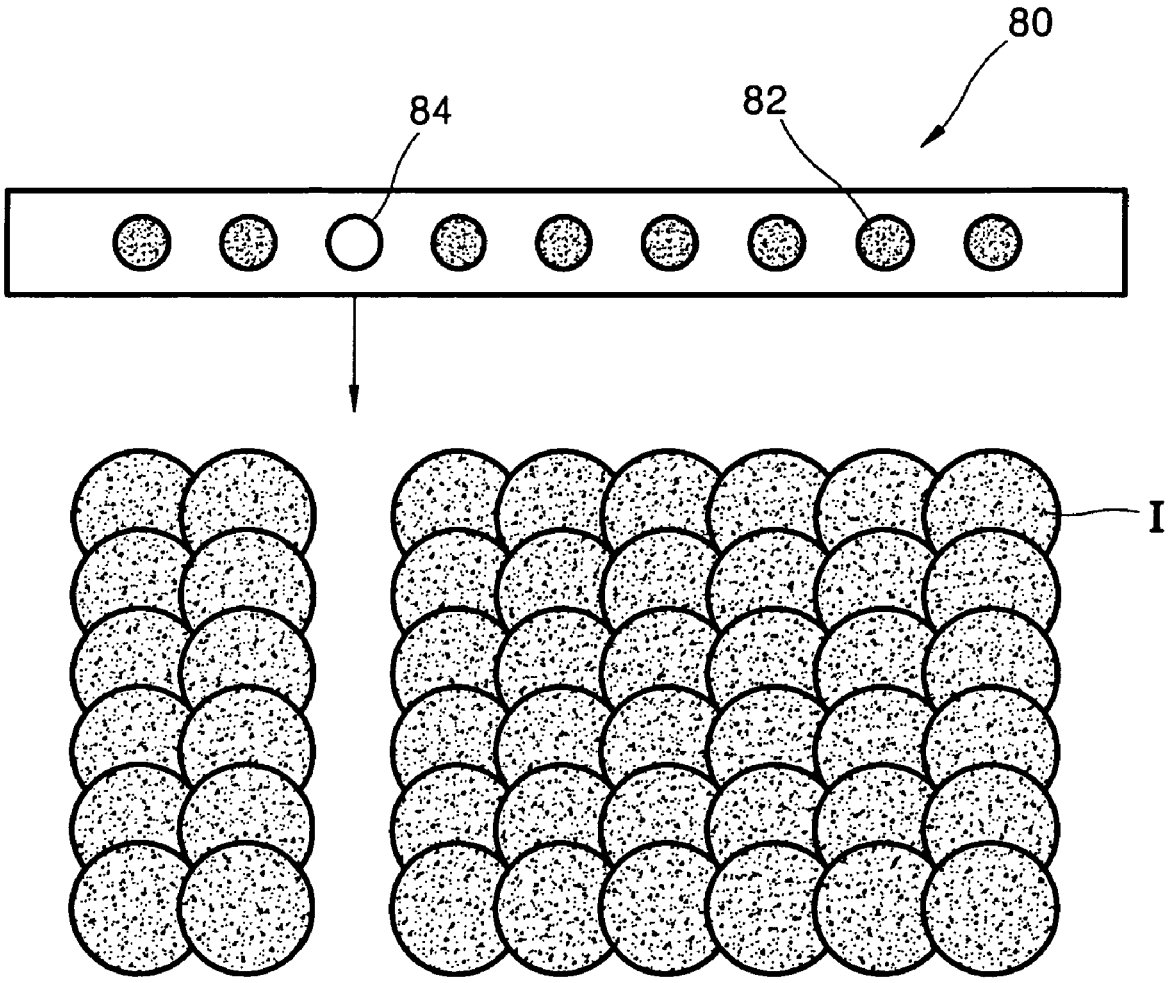
FIG. 1 (PRIOR ART)
FIG. 1 shows printing patterns when there is a defective nozzle in a conventional inkjet image forming apparatus.
Figure 2A:
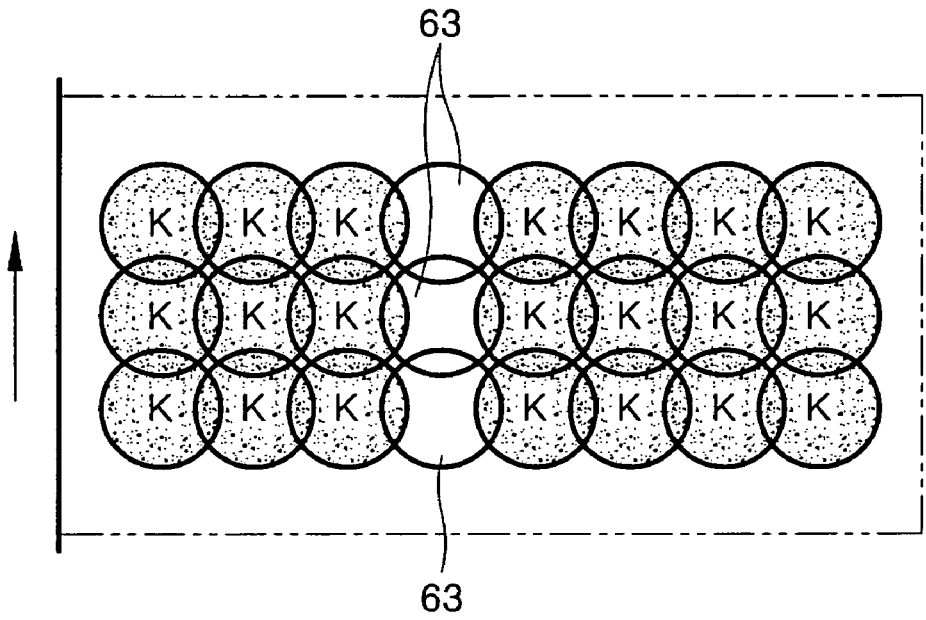
FIG. 2A (PRIOR ART)
FIGS. 2A through 2D are pixel images for explaining a method of compensating for a defective nozzle in the conventional inkjet image forming apparatus.
Figure 2B:
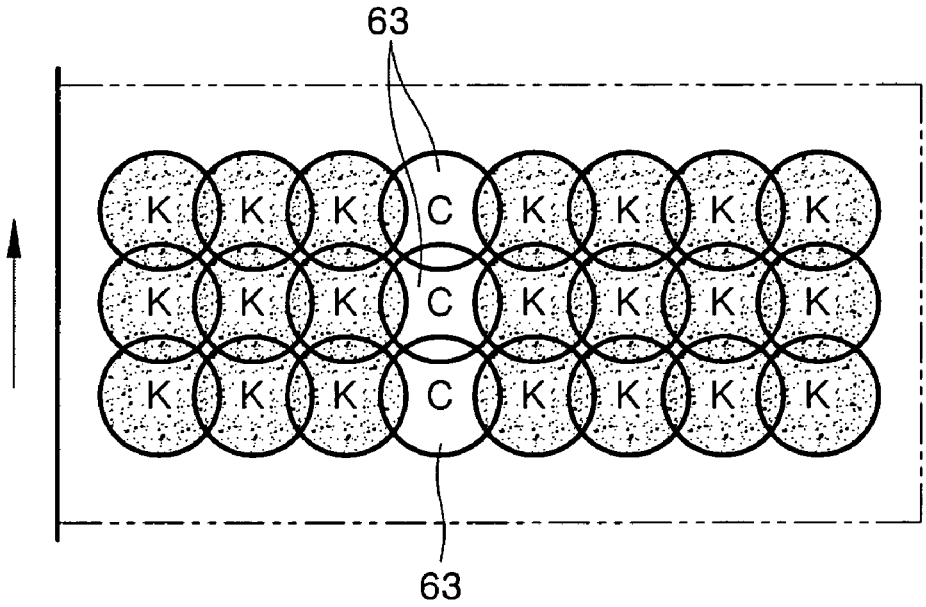
FIG. 2B (PRIOR ART)
Figure 2C:
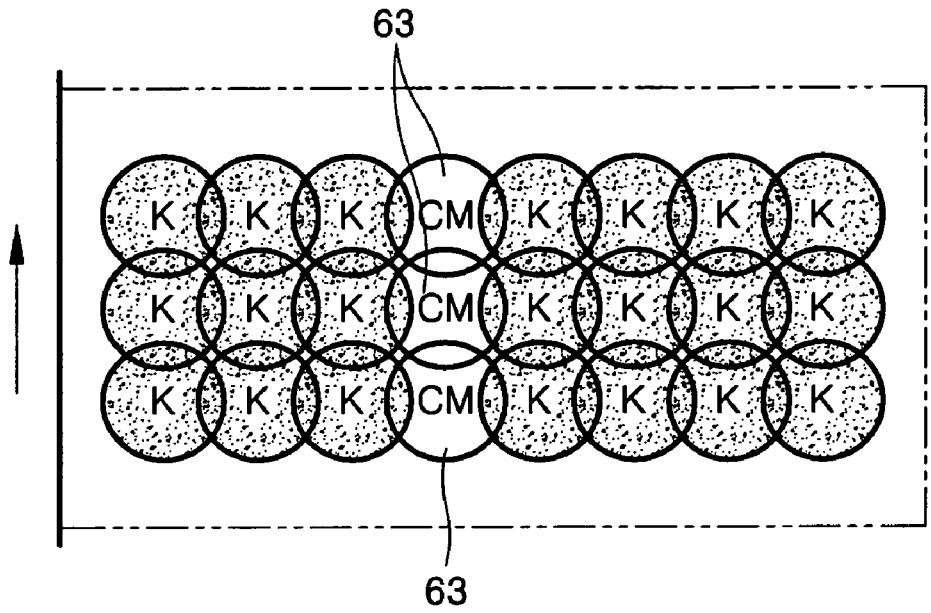
FIG. 2C (PRIOR ART)
Figure 2D:
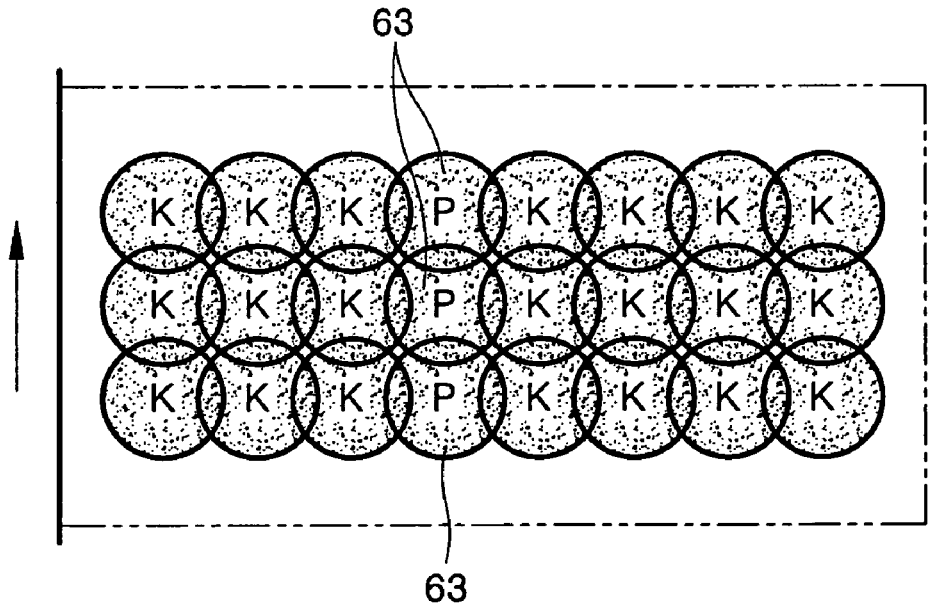
FIG. 2D (PRIOR ART)
Figure 3:
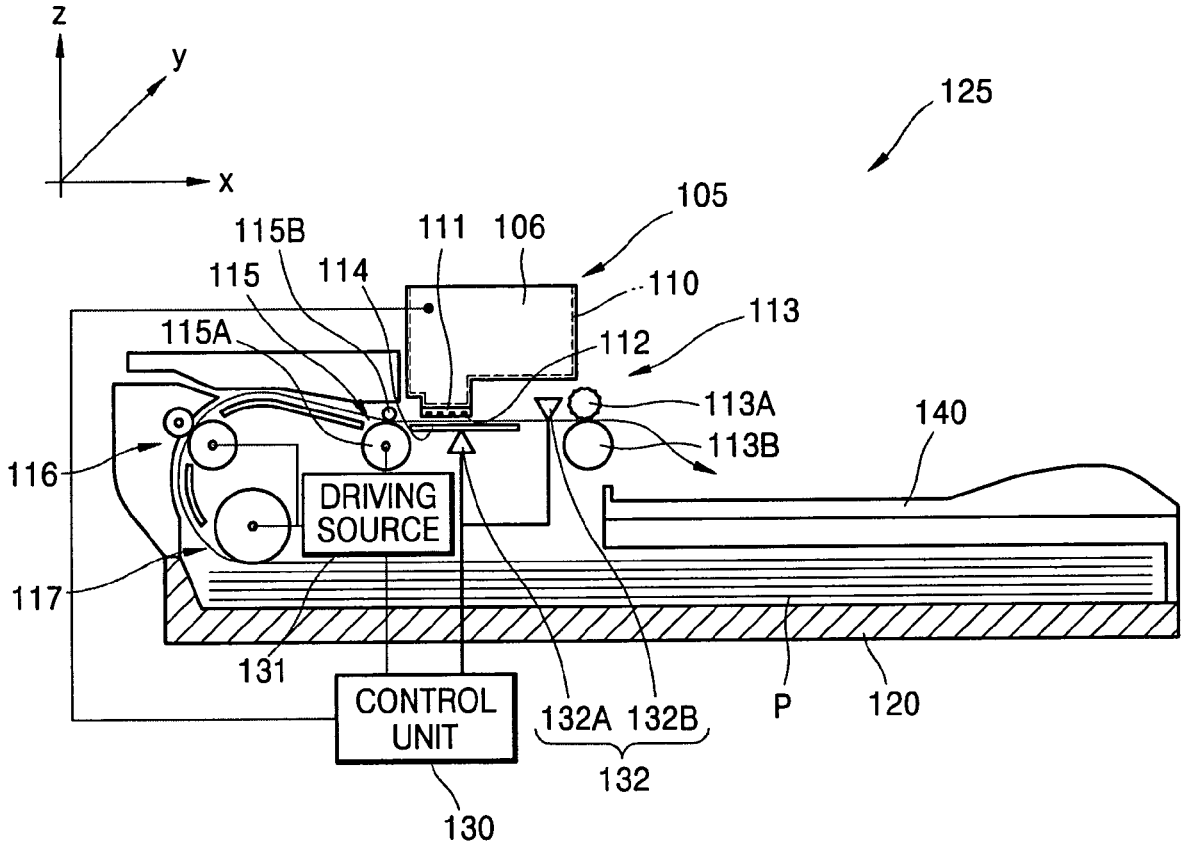
FIG. 3 is a cross-sectional view of an inkjet image forming apparatus according to an exemplary embodiment of the present invention.
Figure 4:
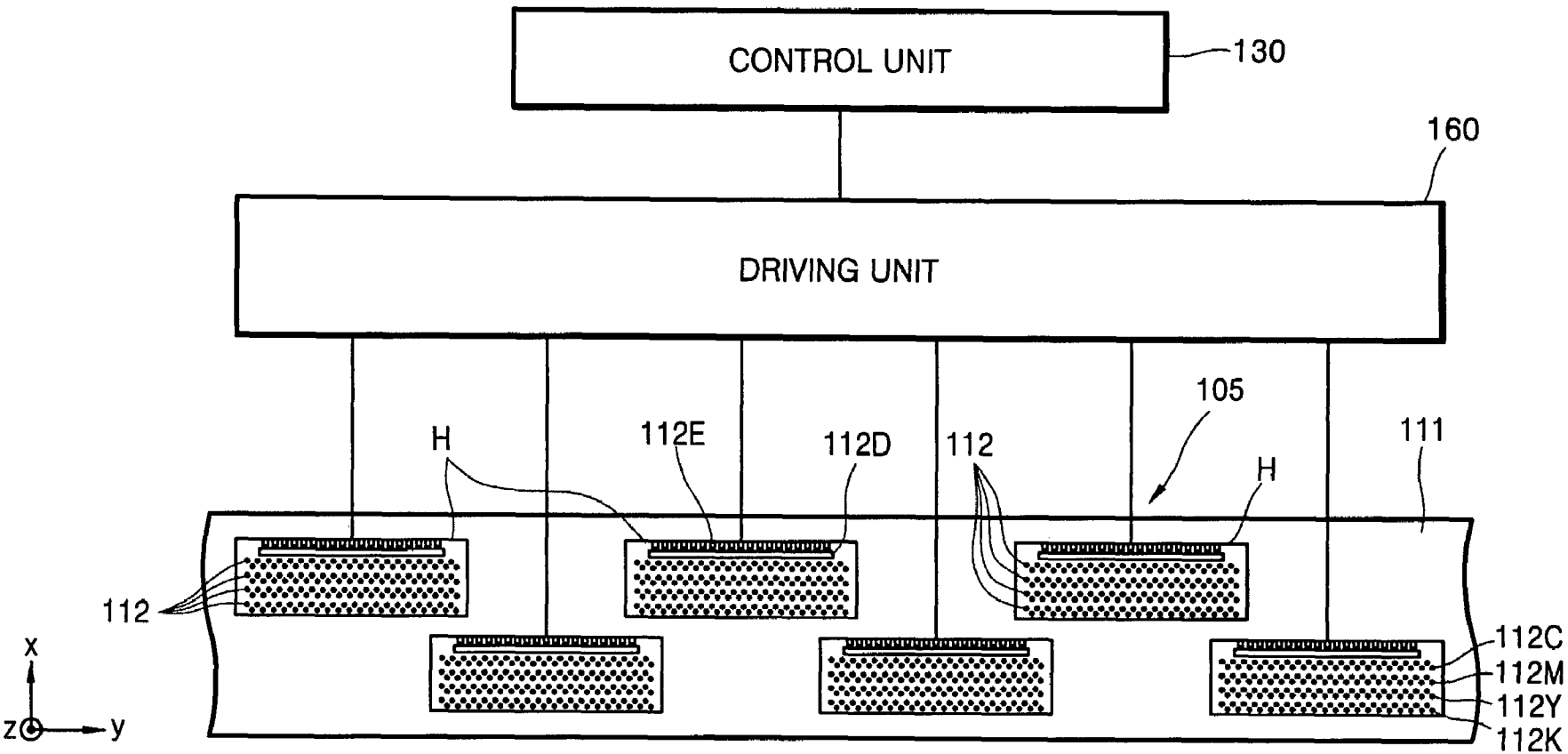
FIG. 4 is a view for explaining a driving mechanism of a printhead of the image forming apparatus of FIG. 3 according to an exemplary embodiment of the present invention.

FIG. 3 is a cross-sectional view of an inkjet image forming apparatus 125 according to an exemplary embodiment of the present invention, and FIG. 4 is a view for explaining a driving mechanism of a printhead of the inkjet image forming apparatus of FIG. 3, according to an exemplary embodiment of the present invention.

Referring to FIGS. 3 and 4, the inkjet image forming apparatus 125 includes a feeding cassette 120, a printhead unit 105, a supporting member 114 opposite to the printhead unit 105, a defective nozzle detecting unit 132 that detects whether a defective nozzle exists and a position of the defective nozzle, a printing medium conveying unit that conveys a printing medium P in a first direction (direction X), and a stacking unit 140 on which a discharged printing medium P is stacked. In addition, the inkjet image forming apparatus 125 includes a driving unit 160, and a control unit 130 that controls the operations of all other elements.

Printing media P are contained in the feeding cassette 120. The printing medium P stacked in the feeding cassette 120 is conveyed by the printing medium conveying unit to the stacking unit 140 via a printhead 111. The printing medium P is discharged and then stacked on the stacking unit 140 such as a discharge tray.

The printing medium conveying unit conveys the printing medium P stacked in the feeding cassette 120 along a predetermined path, and includes a pickup roller 117, auxiliary rollers 116, a feeding roller 115, and a discharge roller 113. The printing medium conveying unit is driven by a driving source 131 such as a motor, which provides a driving force to covey the printing medium P. The operation of the driving source 131 is controlled by the control unit 130, which will be described below.

The pickup roller 117 is installed in one side of the feeding cassette 120, and picks up the printing medium P stacked in the feeding cassette 120. The feeding roller 115 is installed in one side of the printhead 111, and conveys the printing medium P drawn out from the feeding cassette 120 by the pickup roller 117 to the printhead 111. The feeding roller 115 includes a driving roller 115A that provides a transferring force to convey the printing medium P, and an idle roller 115B that is elastically engaged with the driving roller 115A. A pair of auxiliary rollers 116 may be further installed between the pickup roller 117 and the feeding roller 115 to help convey the printing medium P. The discharge roller 113 is installed in a portion where the printing medium P is discharged, and discharges the printing medium P on which an image has been printed to the outside of the image forming apparatus. The discharge roller 113 includes a star wheel 113A installed in a widthwise direction of the printing medium P and a supporting roller 113B that is opposite to the star wheel 113A and supports a back surface of the printing medium P. The star wheel 113A prevents the printing medium P passing under the lower portion of the nozzle unit 112 from contacting the bottom surface of the nozzle unit 112 or a body 110, or prevents a distance between the printing medium P and the bottom surface of the nozzle unit 112 or body 110 from being changed. The star wheel 113A is installed such that at least a portion thereof protrudes from the nozzle unit 112 to contact a point of the top surface of the printing medium P. The printing medium P discharged from the image forming apparatus 125 is stacked on the stacking unit 140.

The supporting member 114 is installed under the printhead 111 and supports the back surface of the conveyed printing medium P to maintain a predetermined distance between the nozzle unit 112 and the printing medium P. Preferably, the distance between the nozzle unit 112 and the printing medium P is about 0.5-2.5 mm.

The defective nozzle detecting unit 132 detects a defective nozzle generated during a manufacturing process or during printing. Furthermore, the defective nozzle detecting unit 132 checks the ejecting status of nozzles adjacent to the defective nozzle as well as the ejecting status of the defective nozzle. For example, the defective nozzle detecting unit 132 checks the ejecting status of each nozzle, and then transmits information about the ejecting status to a memory unit 171 (see FIG. 6), as will be described in further detail below. The defective nozzle is a nozzle that does not eject ink normally or is missing. For example, a defective nozzle indicates a case where ink is not ejected from a nozzle due to various causes or a smaller amount of ink is ejected from a nozzle than a predetermined amount of ink.

A defective nozzle may be generated during manufacturing the printhead 111 or during printing. Generally, information about a defective nozzle generated during the manufacturing process is additionally stored in a memory (not shown) installed in the printhead 111, and transmitted to the image forming apparatus 125 when the printhead 111 is mounted in the image forming apparatus 125.

In general, the printheads of inkjet image forming apparatuses can be classified mainly into two types according to the type of actuator for ejecting ink droplets. The first type is a heat driving type printhead, in which ink droplets are ejected by an expansion force of bubbles generated in ink using a heater, and the second type is a piezoelectric driving printhead, in which ink droplets are ejected by pressure applied to ink due to a change of a piezoelectric element. For instance, when a heater used for ejecting ink is disconnected, a driving circuit of the heater is broken or an electrical element such as a field emission transistor is damaged, the defective nozzle detecting unit 132 can easily detect the defective nozzle. Further, when ink is ejected by driving a piezoelectric element, the defective nozzle detecting unit 132 can easily detect the defective nozzle if the defect is due to the defective piezoelectric element or damage to a driving circuit of the piezoelectric element.

However, there may be a case where a cause of a defective nozzle such as a nozzle clogged with ink or debris is not easily identified. When the cause of a defective nozzle is not clearly identified, test page printing is performed. If a defective nozzle is identified, a portion where printing is performed by the defective nozzle has a lower printing density than a portion where printing is performed by a normal nozzle because of missing dots. Therefore, using the density difference, whether the defective nozzle exists and a position of the defective nozzle can be detected.

According to an exemplary embodiment of the present invention, the defective nozzle detecting unit 132 includes a first detecting unit 132A and a second detecting unit 132B. In an exemplary implementation, the first detecting unit 132A emits light onto the nozzle unit 112 to check whether a nozzle hole is clogged, and the second detecting unit 132B emits light onto the conveyed printing medium P to detect whether a defective nozzle exists. The defective nozzle detecting unit 132 may include a light sensor. The light sensor includes a light emitting sensor (for example, a light emitting diode) that emits light onto the nozzle unit 112 or the printing medium P, and a light receiving unit that receives light reflected from the nozzle unit 112 or the printing medium P. The defective nozzle detecting unit 132 receives an output signal from the light receiving sensor to detect whether a defective nozzle exists, and transmits information on whether the defective nozzle exists to the control unit 130, which will be described later. The light emitting sensor and the light receiving sensor may be integrated with each other or separately included in the light sensor. Structure and effect of the light sensor are well-known to those of ordinary skill in the art, and thus the detailed description thereof will not be described for clarity and conciseness.

Although not illustrated, in an exemplary embodiment of the present invention, the defective nozzle detecting unit may transmit a nozzle check signal to each nozzle of the printhead, and detect whether a defective nozzle exists and a position of the defective nozzle, according to a response to the transmitted signal.

The above methods of detecting a defective nozzle are well-known to those of ordinary skill in the art, and thus the detailed descriptions thereof will not be described for clarity and conciseness. Also, various devices and methods can be used to detect whether a defective nozzle exists and a position of the defective nozzle.

The defective nozzle detecting unit 132 detects whether a defective nozzle exists and a position of the defective nozzle through the above processes. Information about the defective nozzle (hereinafter referred to as defective nozzle information) detected by the defective nozzle detecting unit 132 is stored in the memory, and the control unit 130 controls each of the elements of the inkjet image forming apparatus 125 to compensate for the defective nozzle according to the defective nozzle information. The defective nozzle information contains a position of the defective nozzle, an ink color of the defective nozzle, or the like.

The printhead unit 105 forms an image by ejecting ink onto a printing medium P, and includes the body 110, the printhead 111 installed in one side of the body 110, the nozzle unit 112 installed in the printhead 111, and a carriage 106 on which the body 110 is mounted. The body 110 is mounted on the carriage 106 in a cartridge manner. The feeding roller 115 is installed in a portion of the nozzle unit 112 into which the printing medium P is fed, and the discharge roller 113 is rotatably installed in a portion of the nozzle unit 112 where the printing medium P is discharged.

Although not illustrated, an ink container is formed in the body 110. Moreover, the body 110 includes chambers, each of which has ejecting units (for example, piezoelectric elements or heat-driving type heaters) that are connected to respective nozzles of the nozzle unit 112 and provide pressure to eject the ink, channels (for example, orifices) for supplying the ink contained in the body 110 to each chamber, a manifold that is a common channel for supplying the ink flowed through the channel to the chamber, and a restrictor that is an individual channel for supplying the ink from the manifold to each chamber. The chambers, the ejecting units, the channel, the manifold, and the restrictor are well-known to a person having ordinary skill in the art, and thus the detailed descriptions thereof will not be described for clarity and conciseness. The ink container may be installed separately from the printhead unit 105. The ink contained in the ink container is provided to the printhead unit 105 via a providing unit such as a hose.

Referring to FIG. 4, the driving unit 160 provides an ejecting force to eject ink droplets, and drives the nozzle unit 112 with a predetermined frequency. Accordingly, the nozzle unit 112 ejects ink droplets and prints an image onto the printing medium P.

Generally, the printhead 111 can be of two types: a shuttle type and a page width type. A shuttle type printhead forms an image while moving forwards and backwards in a direction perpendicular to a transferring direction of a printing medium P. A page width printing type printhead has a length at least corresponding to a width of a printing medium P. Certain exemplary embodiments of the present invention can be applied to inkjet image forming apparatuses including a shuttle type printhead or a page width printing type printhead. Hereinafter, for convenience of explanation, the printhead 110 is of a page width printing type, however, the printhead 111 can also be of a shuttle type.

Referring to FIGS. 3 and 4, the printhead 111 is installed in a second direction (direction Y) with respect to a printing medium P which is conveyed in a first direction (direction X). The printhead 111 uses heat energy or a piezoelectric element as an ink ejecting source, and is fabricated to have a high resolution through a semiconductor manufacturing process such as etching, deposition, and sputtering. The nozzle unit 112 is formed on the printhead 111 to form an image by ejecting ink onto the printing medium P.

The nozzle unit 112 has a length at least corresponding to a width of the printing medium P, or may be formed to be longer than the width of the printing medium P. As illustrated in FIG. 4, a plurality of head chips H on which a plurality of nozzle arrays 112C, 112M, 112Y, and 112K are formed are included in the printhead 111. In FIG. 4, reference numerals 112C, 112M, 112Y, and 112K denote a cyan nozzle array, a magenta nozzle array, a yellow nozzle array, and a black nozzle array, respectively. Each of the head chips H may be formed as a single head chip with a length corresponding to a length of the printhead 111, that is, a width of the printing medium P.

Each nozzle formed on the nozzle unit 112 is connected to a driving circuit 112D and a cable 112E through which a driving signal, an electric power for ejecting ink, and image data are transmitted from the control unit 130 (referring to FIG. 4). The cable 112E may be a flexible cable such as a flexible printed circuit (FPC) or a flexible flat cable (FFC).

Figure 5:
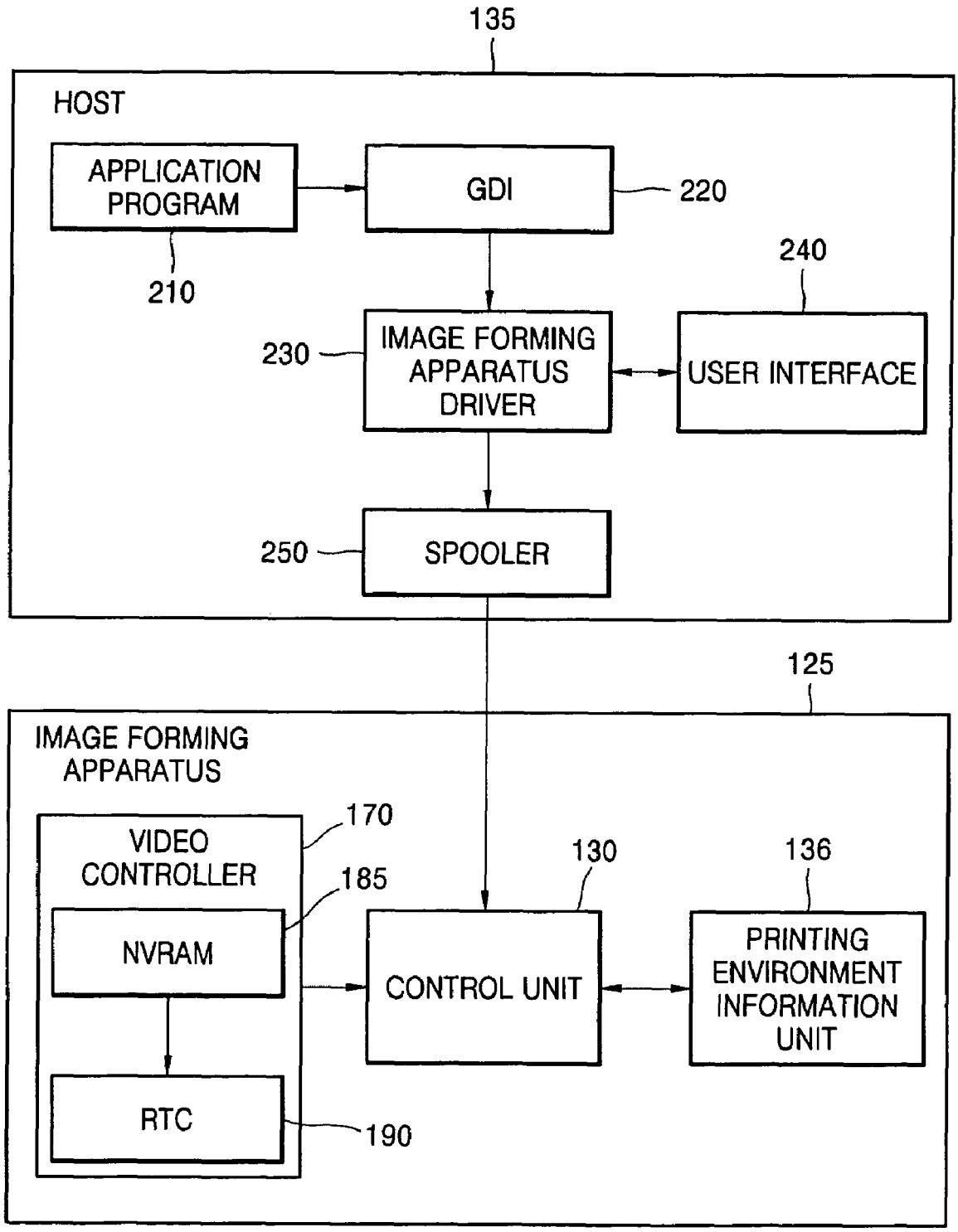
FIG. 5 is a block diagram of an image forming system according to an embodiment of the present invention.
Figure 6:
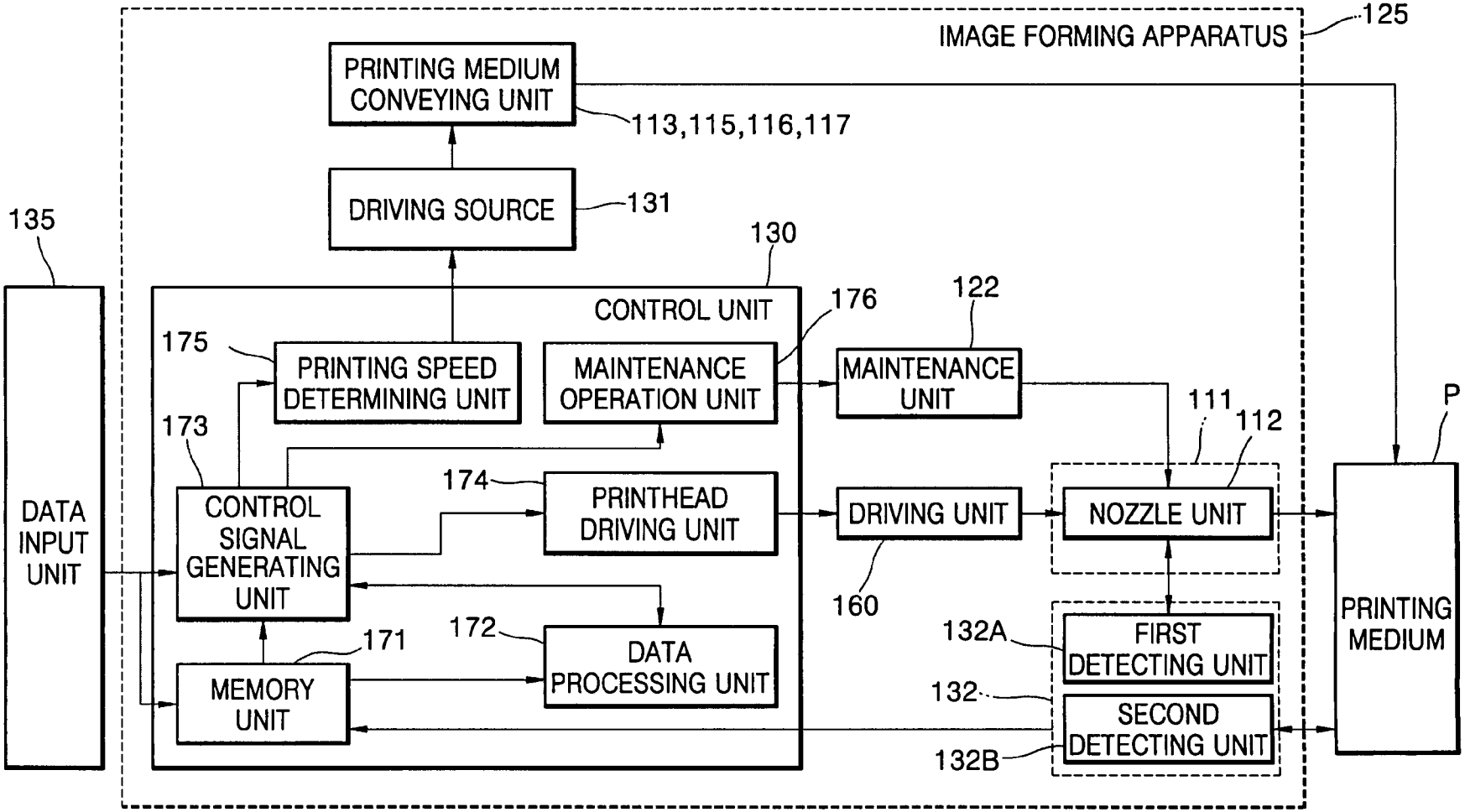
FIG. 6 is a block diagram of the inkjet image forming apparatus illustrated in FIG. 5.

FIG. 5 is a block diagram of an image forming system according to an exemplary embodiment of the present invention, and FIG. 6 is a block diagram of the inkjet image forming apparatus 125 illustrated in FIG. 5. The image forming system of FIG. 5 includes a data input unit 135 and the inkjet image forming apparatus 125.

Referring to FIGS. 5 and 6, the data input unit 135 denotes a host system such as a personal computer (PC), a digital camera, or a personal digital assistant (PDA), and receives image data to be printed in order of pages. The data input unit 135 includes an application program 210, a graphics device interface (GDI) 220, an image forming apparatus driver 230, a user interface 240, and a spooler 250.

The application program 210 generates and edits an object that can be printed using the image forming apparatus 125. The GDI 220 is a program in an operation system of the host system, receives the object generated by the application program 210 and transmits the object to the image forming apparatus driver 230, and generates an instruction about the object required by the image forming apparatus driver 230. The image forming apparatus driver 230 is a program present on the host system, and generates an instruction that can be interpreted by the image forming apparatus 125. The user interface 240 for the image forming apparatus driver 230 is a program in the host system, and provides environment variables for the image forming apparatus driver 230 to generate the instruction. A user selects a desired printing mode such as a draft mode, a normal mode, or a high-resolution mode, and a type of printing medium such as plain paper, photo paper, or a transparent film via the user interface 240. The spooler 250 is a program in the host system that transmits the instruction generated by the image forming apparatus driver 230 to a physical input/output device (not shown) connected to the image forming apparatus 125.

The image forming apparatus 125 includes a video controller 170, the control unit 130, and a printing environment information unit 136. The video controller 170 includes a non-volatile random access memory (NVRAM) 185, an SRAM (not shown), an SDRAM (not shown), a NOR Flash (not shown), and a real-time clock (RTC) 190. The video controller 170 interprets the instruction generated by the image forming apparatus driver 230 and converts the instruction into a bitmap, and then transmits the bitmap to the control unit 130. The control unit 130 transmits the bitmap generated by the video controller 170 to each of the elements of the image forming apparatus 125 to form an image on a printing medium P. A printing operation of the image forming apparatus 125 is performed through the processes described above.

A maintenance unit 122 maintains the nozzle unit 112 in a printing standby state in order to implement good printing quality, and includes, although not illustrated, a capping device that covers the nozzle unit 112, a wiping device that wipes off the nozzle unit 112, and an ink container that contains ink ejected from the nozzle unit 112 during spitting. The maintenance unit 122 is controlled by the control unit 130. For example, the control unit 130 controls a maintenance operation unit 176 to drive the maintenance unit 122 when detecting a defective nozzle.

If printing is not performed for a predetermined time or a nozzle does not eject ink for a predetermined time during printing, ink on a nozzle surface is dried and viscosity of the ink is increased, which can cause an ejecting failure. A spitting device removes the ink of increased viscosity from the nozzle surface by ejecting a small amount of ink several times. That is, to prevent the nozzle from drying and abnormally ejecting ink, the spitting device spits ink through the nozzle before or during printing.

When an amount of ink remaining on the surface of the nozzle unit 112 increases, a path of ink droplets may be changed. Thus, printing quality can be seriously affected. The wiping device removes dried ink or ink remaining around the nozzles by rubbing the surface of the nozzle unit 112.

Meanwhile, if the inkjet image forming apparatus 125 is not used for a long time or stays in a printing standby state, ink in the nozzle unit 112 of the printhead 111 may dry or the nozzle unit 112 may be contaminated by dirt. The capping device covers the nozzle unit 112 to block external air, thereby preventing ink in the nozzle unit 112 from drying or being contaminated. The maintenance unit 122 sucks ink remaining in the nozzle hole of the nozzle unit 112 to clean the nozzle unit 112. The structure and effect of the maintenance unit 122 are well-known to a person of ordinary skill in the art, and thus the detailed descriptions thereof will not be described for clarity and conciseness.

The printing environment information unit 136 stores a plurality of pieces of printing environment information required when respective image data received from the application program 210 are printed according to a predetermined printing environment. The printing environment information unit 136 stores respective printing environment information input from the user interface unit 240. The printing environment information includes at least one of a printing mode, a type of printing medium, printing density, resolution, a size of the printing medium, a temperature, humidity, and whether successive printing is performed. The control unit 130 controls the operation of the driving unit 160 or the driving source 131 according to each piece of the printing environment information stored in the printing environment information unit 136.

The control unit 130 is installed on a motherboard, and controls an ejecting operation of the nozzle unit 112 formed on the printhead 111, a maintenance operation, and a transferring operation of the printing medium conveying unit according to whether a defective nozzle is detected by the defective nozzle detecting unit 132. As illustrated in FIG. 6, the control unit 130 includes the memory unit 171, a data processing unit 172, a control signal generating unit 173, a printhead driving unit 174, a printing speed determining unit 175, and a maintenance operation unit 176.

The control unit 130 stores the image data input from the data input unit 135 in the memory unit 171, and checks whether the image data to be printed is completely stored in the memory unit 171. The memory unit 171 stores defective nozzle information (for example, a position of the defective nozzle) detected by the defective nozzle detecting unit 132.

The data processing unit 172 analyzes image information of image data which will be printed at a compensation position and image data which will be printed around the compensation position based on the defective nozzle information stored in the memory unit 171. The compensation position denotes a position at which ink would be deposited on the printing medium P if the defective nozzle normally ejected the ink onto the printing medium P. The data processing unit 172 processes each image data such that at least three pieces of image data, which will be printed at the compensation position, and positions adjacent to the compensation position are swapped and then printed according to the ejecting statuses of the nozzles. That is, the data processing unit 172 processes the image data such that at least three pieces of image data, which will be printed at the compensation position and at the adjacent positions, are swapped and then printed when the defective nozzle exists. At this time, the date processing unit 172 may swap the image data such that the image data can be printed according to their original colors.

The control signal generating unit 173 generates and outputs control signals for controlling the operations of the printhead driving unit 174, the printing speed determining unit 175, and the maintenance operation unit 176 based on the image data and information about the defective nozzle and adjacent nozzles, which are transmitted from the data processing unit 172 and the memory unit 171.

The printhead driving unit 174 receives the control signal from the control signal generating unit 173, and prints an image on a printing medium P by driving the driving unit 160 according to the transmitted control signal.

The printing speed determining unit 175 receives the control signal from the control signal generating unit 173 and drives the driving source 131. The printing medium conveying unit receiving the driving force from the driving source 131 conveys the printing medium P along a predetermined path.

The maintenance operation unit 176 receives the control signal from the control signal generating unit 173 and operates the maintenance unit 122 to maintain the nozzle unit 112 in a printing standby state.

Hereinafter, an operation of the control unit 130 will be described in detail in connection with FIG. 7 according to an exemplary embodiment of the present invention.

Figure 7:
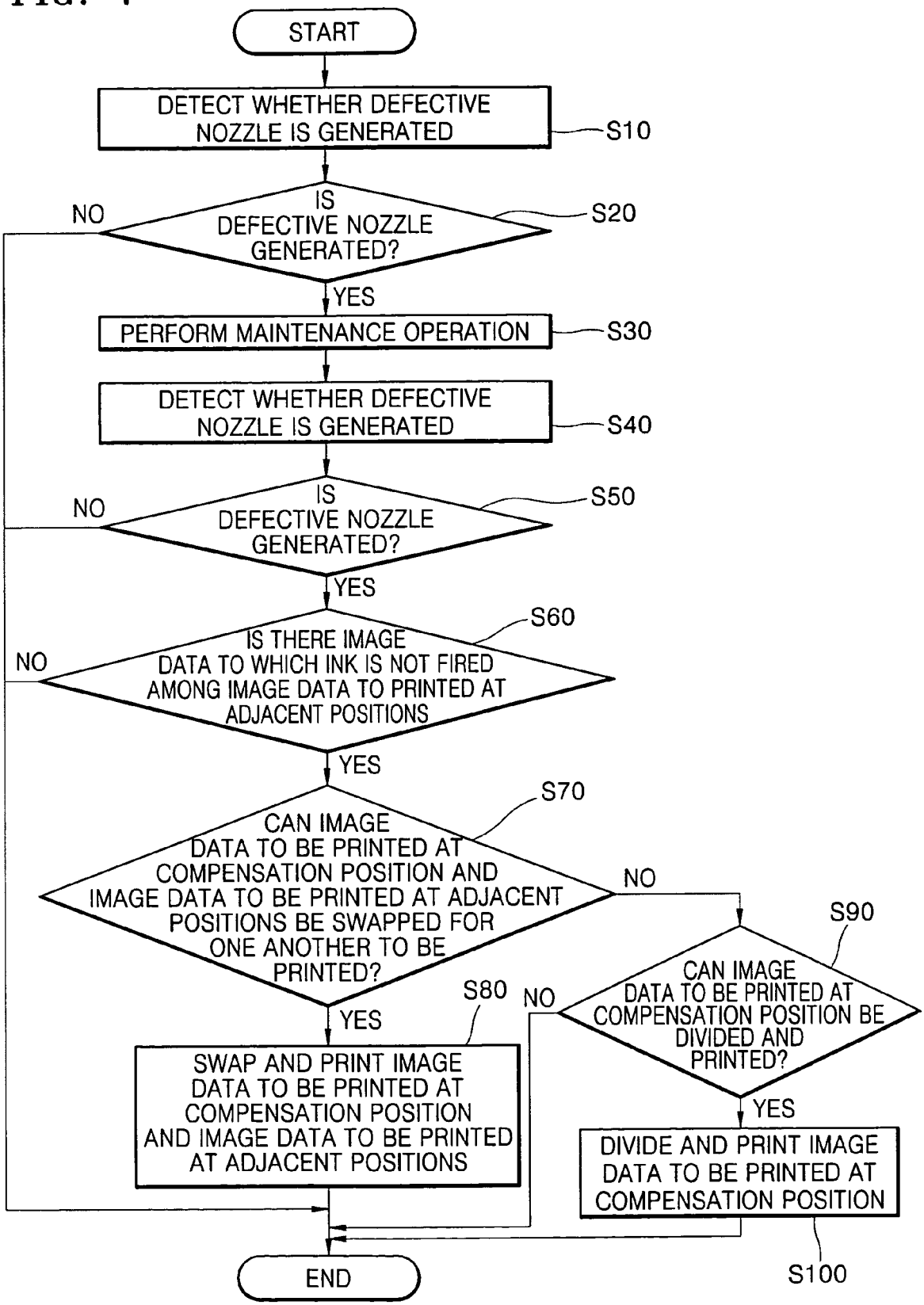
FIG. 7 is a flowchart illustrating a method of compensating for a defective nozzle according to an exemplary embodiment of the present invention.
Figure 8:
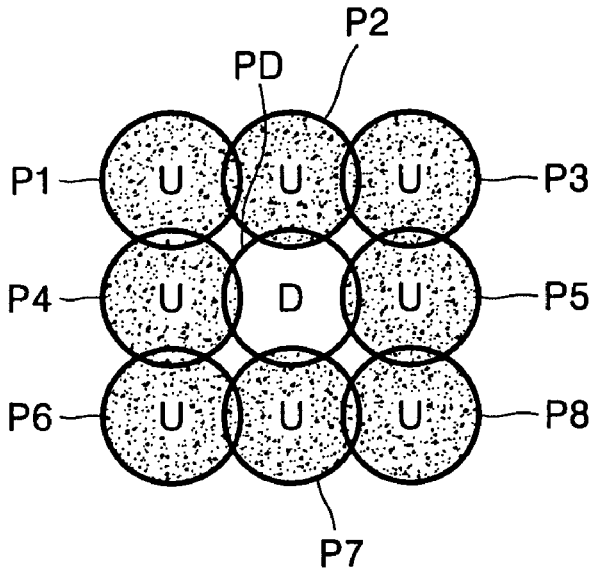
FIG. 8 is a dot image for explaining a compensation position and positions adjacent to the compensating position with respect to the method of FIG. 7.

FIG. 7 is a flowchart illustrating a method of compensating for a defective nozzle according to an exemplary embodiment of the present invention, and FIG. 8 is a dot image for explaining a compensation position and positions adjacent to the compensating position with respect to the method of FIG. 7. In FIG. 8, reference character PD denotes a compensation position on a printing medium corresponding to a defective nozzle. Reference numeral P1, P2, P3, P4, P5, P6, P7 and P8 denote positions adjacent to the compensation position PD. Thus, P1 denotes a left upper position, P2 denotes an upper position, P3 denotes a right upper position, P4 denotes a left position, P5 denotes a right position, P6 denotes a left lower position, P7 denotes a lower position, and P8 denotes a right lower position. Reference character 'D' denotes an ink dot ejected from the defective nozzle, and reference character 'U' denotes an ink dot ejected from a nozzle. Image data printed at each position may be formed by ejecting ink from a single nozzle, or may be formed by ejecting ink from two or more nozzles.

Referring to FIGS. 5, 6 and 7, the defective nozzle detecting unit 132 detects whether a defective nozzle of the nozzle unit 112 exists (step S10). Defective nozzle information is stored in the memory unit 171, and then transmitted to the data processing unit 172 and the control signal generating unit 173. A method of detecting the defective nozzle is the same as the method described above, and thus the detailed description thereof will not be described for clarity and conciseness.

When a defective nozzle is not detected, the control unit 130 prints an image by driving the nozzle unit 112 when the printing medium P is about to be fed into the nozzle unit 112. At this time, the control signal generating unit 173 generates and outputs control signals for controlling the printhead driving unit 174 to print the image onto the printing medium P, and the driving unit 160 receives the control signals from the printhead driving unit 174 and drives the nozzle unit 112 (step S20).

When a defective nozzle is detected, information about the defective nozzle and adjacent nozzles (for example, whether each nozzle ejects normally ink) is stored in the memory unit 171, and then transmitted to the data processing unit 172 and the control signal generating unit 173 (step S20). The control signal generating unit 173 generates and outputs the control signals for controlling the maintenance operation unit 176. The maintenance operation unit 176 receives the control signals and controls the maintenance unit 122 to perform a maintenance operation for returning the nozzle unit 112 to a standby state (step S30). For example, the control unit 130 performs a recovery operation for the nozzle unit 112, that is, a maintenance operation such as spitting and suction to fix the defective nozzle. After the maintenance operation, the defective nozzle detecting unit 132 detects again whether a defective nozzle exists in order to determine whether the defective nozzle was fixed (step S40). After determining whether the defective nozzle was fixed (step S50), if a determination is made that the defective nozzle was not fixed, the control unit 130 performs an operation for compensating for the defective nozzle.

Referring to FIGS. 7 and 8, during the detecting of the defective nozzle, the control unit 130 analyzes image information of image data which is printed at the compensating position PD by the defective nozzle and image data which are printed at the adjacent positions P1, P2, P3, P4, P5, P6, P7 and P8, and ejecting statuses of the nozzles printing the image data onto the positions PD and P1-P8 (step S60).

The control unit 130 swaps at least three pieces of image data printed at the compensation position PD and the adjacent positions P1-P8 and prints them to compensate for image quality degradation due to the defective nozzle. At this time, the control unit 130 swaps the image data such that the image data can be printed according to their original colors.

When a nozzle ejecting cyan ink at a composition position PD is a defective nozzle compensated for by swapping image data to be printed at positions P1, P2, and PD will be descried as an example. It is assumed that cyan+yellow image data to be printed at the compensation position PD, magenta+cyan image data to be printed at the position P1, and magenta+yellow image data to be printed at the position P2 are input from the data input unit 135. At this moment, since cyan ink cannot be ejected onto the compensation position PD; the control unit 130 may process the image data such that the magenta+yellow image data to be printed at the position P2 is placed at the compensation position PD, the cyan+yellow image data to be printed at the compensation position PD is placed at the position P1, the magenta+cyan image data to be printed at the position P1 is placed at the position P2. If the magenta+cyan image data to be printed at the position P1 is moved to be printed at the compensation position PD, the compensation position PD is printed only by magenta color due to the defective nozzle, and thus the defective nozzle cannot be properly compensated for. The processes described above are performed by the data processing unit 172 according to the defective nozzle information transmitted from the memory unit 171. As described above, the control unit 130 compensates for the defective nozzle according to the ejecting statuses of the nozzles and analyzed image information.

When image data desired to be printed is input to the image forming apparatus 125, the control unit 130 controls the nozzle unit 112 to form a print image corresponding to the image data on the printing medium P. The image data includes image data corresponding to an area to be printed with ink of a predetermined color ejected from the nozzle unit 112 and image data corresponding to an area where the nozzle unit 112 does not eject ink. The print image corresponding to the image data is formed on the printing medium P by combining the area having the predetermined color and the area where the ink is not ejected.

For example, the print image is formed by image data corresponding to the area where the predetermined color ink is ejected and image data corresponding to the area where ink is not ejected from the nozzle unit 112. The control unit 130 detects whether image data corresponding to the area where ink is not ejected exists among image data to be printed at the adjacent positions P1-P8 (step S60). Then, the control unit 130 determines whether the image data to be printed at the compensation position PD and the image data to be printed at the adjacent positions P1-P8 can be swapped for each other (step S70). The control unit 130 checks whether there is a defective nozzle among the nozzles which will eject ink at the adjacent positions P1-P8, analyzes the image data to be printed at the adjacent positions P1-P8, and then swaps the image data and print image data to compensate for the defective nozzle if a determination is made that the image data to be printed at the adjacent positions P1-P8 can be swapped for one another and then printed (step S80). The control unit 130 swaps and prints the image data by swapping and transmitting driving data to each of the nozzles formed on the nozzle unit 112. That is, the data processing unit 172 swaps the image data desired to be printed, and then transmits the swapped image data to each of the nozzles of the nozzle unit 112.

When there is a defective nozzle among the nozzles that prints image data at the adjacent positions P1-P8 or the image data cannot be swapped for one another, the control unit 130 determines whether the image data to be printed at the compensation position PD can be divided (step S90). For example, when the image data to be printed at the adjacent positions P1-P8 has the same color as the ink color of the defective nozzle or the swapped image data cannot be printed in a desired color, the image data cannot be swapped. If the image data to be printed at the compensation position PD can be divided, the control unit 130 divides and prints the image data to be originally printed at the compensation position PD and the adjacent positions P1-P8 (step S 100).

When the image data cannot be swapped with one another and printed, the control unit 130 divides and prints the image data to be originally printed at the compensation position PD and at a position among the adjacent positions P1-P8 (hereinafter, referred to as a third position). Accordingly, to improve a compensation effect, the image data to be printed at the third position may be image data corresponding to the area where the ink is not ejected. Furthermore, the image data to be printed at the compensation position PD may be printed by ink ejected from two nozzles. For example, at the compensation position PD, image data formed by ink ejected from two nozzles, for example, cyan+magenta ink, magenta+yellow ink, or yellow+cyan ink, is printed. The control unit 130 controls the driving unit 160 to print ink of the same color as the ink color of the defective nozzle at the third position and print other colors at the compensation position PD.

Figure 9:
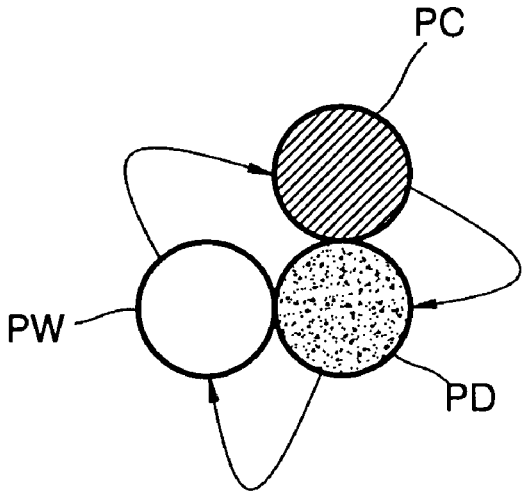
FIG. 9 is a dot image for explaining a method of swapping and printing three pieces of image data according to an exemplary embodiment of the present invention.

FIG. 9 is a dot image for explaining a method of swapping and printing three pieces of image data, according to an exemplary embodiment of the present invention.

Referring to FIGS. 6, 8, and 9, the control unit 130 compares information about the image data to be printed at the compensation position PD with information about the image data to be printed at the adjacent positions P1-P8. At this time, the control unit 130 determines whether there is image data corresponding to the area where ink is not ejected among the image data to be printed at the adjacent positions P1-P8. The processes described above are performed by the data processing unit 172 according to the defective nozzle information transmitted from the memory unit 171.

Then, the control unit 130 swaps the image data to be printed at the compensation position PD and two pieces of image data to be printed at a first position PC and a second position PW, which are included in the adjacent positions P1-P8, for each other and then controls the nozzle unit 112 to print them. The first position PC is one of the upper position P2 or the lower position P7, and the second position PW is one of the positions P1, P3, P4, P5, P6 or, P8.

To improve the compensation effect, one of the swapped image data may be image data corresponding to the area where ink is not ejected. For example, the image data to be printed at the second position PW is desirably image data corresponding to the area where the ink is not ejected. Moreover, when the defective nozzle is compensated for, shifting two of the three pieces of image data and then printing is more desirable than all pieces of three image data being shifted and printed. In an exemplary implementation, since the first position PC (one of the upper position P2 or the lower position P7 with respect to the compensation position PD) is located in the same direction as the defective nozzle and the conveying direction of the printing medium P, ink of the same color as the defective nozzle is not printed at the first position PC. Therefore, at the first position PC, which is one of the upper position P2 and the lower position P7, image data corresponding to ink of a different color from the ink of the defective nozzle is desirably printed. As described above, when three pieces of image data to be shifted are determined, the control unit 130 shifts the image data to be printed at the compensation position PD to the second position PW, the image data to be printed at the second position PW to the first position PC, and the image data to be printed at the first position PC to the compensation position PD, and then controls the nozzle unit 112 to print the image data. That is, the control unit 130 shifts the three pieces of image data such that the three pieces of image data can be printed according to their original colors.

Hereinafter, a case where image data to be printed at the compensation position PD is divided and printed when swapping and printing the image data is impossible will be described.

Figure 10:
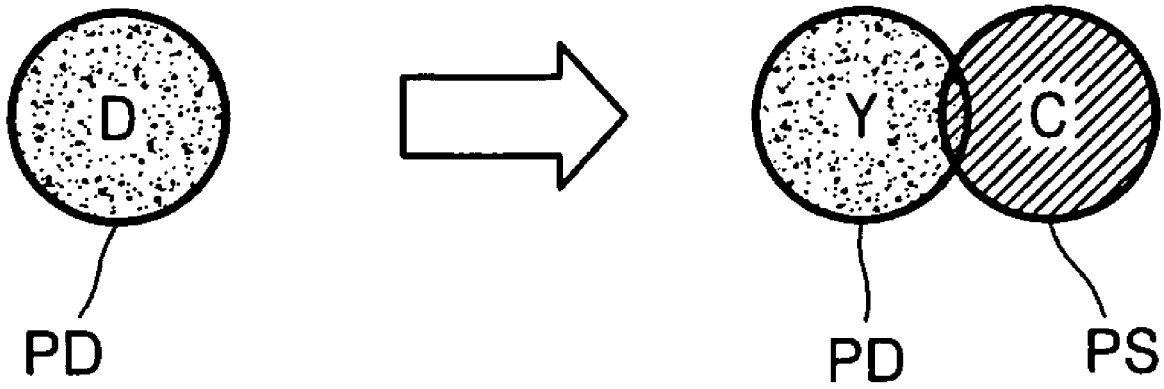
FIG. 10 is a dot image for explaining a method of dividing image data to be printed and printing image at a compensation position according to an exemplary embodiment of the present invention.

FIG. 10 is a dot image for explaining a method of dividing and printing image data to be printed at the compensation position, according to an exemplary embodiment of the present invention.

Referring to FIGS. 6, 8, and 10, the control unit 130 compares information about image data to be printed at the compensation position PD with information about image data to be printed at the adjacent positions P1-P8. At this time, the control unit 130 determines whether there is image data corresponding to an area to which ink is not ejected among the image data to be printed at the adjacent positions P1-P8. The processes described above will be performed by the data processing unit 172 according to the defective nozzle information transmitted from the memory unit 171.

Then, the control unit 130 divides the image data to be originally printed at the compensation position PD, and the image data is then printed at the compensation position PD and a third position PS, which is one of the adjacent positions P1-P8. For example, it is assumed that ink of cyan+yellow colors is printed at the compensation position PD when input image data is printed in an original form and a cyan (C) nozzle is defective. In this case, cyan (C) ink cannot be printed at the compensation position PD. Therefore, the control unit 130 controls the nozzle unit 112 to print yellow (Y) ink at the compensation position PD, and prints cyan (C) ink at the third position PS. By dividing and printing the image data, the image quality degradation due to the defective nozzle can be compensated for. Thus, the image data divided and printed at the adjacent positions can be viewed as if image data of original colors are printed at the right positions due to an optical illusion. Accordingly, an effect caused by the defective nozzle can be compensated for.

As described above, according to exemplary embodiments of the present invention, image data to be printed at a compensation position is swapped for image data to be printed at positions adjacent to the compensation position and then printed. Furthermore, when the image data cannot be swapped to be printed, the image data to be printed at the compensation position is divided and printed at the compensation position and the adjacent positions.

As described above, a method of compensating for a defective nozzle in an inkjet image forming apparatus according to exemplary embodiments of the present invention swaps or divides the image data and then prints the image data. Thus, image quality degradation such as a visible white line can be prevented. In addition, certain exemplary embodiments of the present invention can compensate for a defect of a black nozzle or defects of nozzles ejecting ink of other colors. Moreover, by compensating for the defective nozzle, the life span of a printhead can be prolonged.

While the present invention has been particularly shown and described with reference to certain exemplary embodiments thereof, it will be understood by those skilled in the art that various changes in form and details may be made therein without departing from the spirit and scope of the present invention as defined by the appended claims.

What is claimed is:

1. A method of compensating for a defective nozzle in an inkjet image forming apparatus, the method comprising:

detecting a defective nozzle of a nozzle unit;

checking ejecting statuses of nozzles of the nozzle unit which eject ink at a compensation position on a printing medium corresponding to the defective nozzle and nozzles of the nozzle unit which eject ink at positions adjacent to the compensation position, when the defective nozzle is detected;

analyzing image information of the image data to be printed at the compensation position and the image data to be printed at the adjacent positions;

detecting whether there is image data corresponding to an area to which ink is not ejected among the image data to be printed at the adjacent positions; and swapping and printing at least three pieces of image data to be printed at the compensation position and the adjacent positions according to the ejecting statuses of the nozzles, wherein the three pieces of image data to be printed at the compensation position, and a first and a second position among the image data to be printed of the adjacent positions are swapped for one another according to the ejecting statuses of the nozzles and the analyzed image information, and wherein the first position comprises at least one of an upper position and a lower position, rather than the compensation position, wherein the image data to be printed at the compensation position is shifted to the second position, the image data to be printed at the second position is shifted to the first position, and the image data to be printed at the first position is shifted to the compensation position when image data corresponding to an area to which ink is not ejected is printed at the second position.

2. The method of claim 1, wherein when the image data cannot be swapped for one another, the image data to be printed at the compensation position is divided and printed at the compensation position and the adjacent positions adjacent to the compensation position.

3. The method of claim 1, wherein when the image data cannot be swapped for one another, the image data to be printed at the compensation position is divided and printed at the compensation position and a third position which comprises one of the adjacent positions.

4. The method of claim 3, wherein the image data to be printed at the third position comprises image data corresponding to an area to which ink is not ejected.

5. The method of claim 4, wherein the image data to be printed at the compensation position is printed by ink ejected from two nozzles.

6. The method of claim 5, wherein ink of the same color ejected from the defective nozzle is printed at the third position and ink of a different color is printed at the compensation position.

7. The method of claim 1, wherein when the image data cannot be swapped for one another, image data to be printed at the compensation position is divided and printed at the compensation position and the adjacent positions adjacent to the compensation position.

8. The method of claim 1, wherein when the image data are swapped for one another, driving data are swapped and transmitted to respective nozzles of the nozzle unit.

9. The method of claim 1, wherein the adjacent positions of the compensation position comprises an upper position, a lower position, a left position, a left upper position, a left lower position, a right position, a right upper position, and a right lower position.

10. The method of claim 1, wherein the nozzle unit comprises a length corresponding to a width of a printing medium.

11. The method of claim 1, further comprising performing a maintenance operation to return the nozzle unit to a printing standby state when the defective nozzle is detected.

12. The method of claim 11, further comprising detecting a defective nozzle of the nozzle unit after performing the maintenance operation.

13. An apparatus for compensating for a defective nozzle, the apparatus comprising:

a defective nozzle detecting unit for detecting a defective nozzle of a nozzle unit, and checking ejecting statuses of nozzles of the nozzle unit which eject ink at a compensation position on a printing medium corresponding to the defective nozzle and nozzles of the nozzle unit which eject ink at positions adjacent to the compensation position, when the defective nozzle is detected; and a data processing unit for analyzing image information of the image data to be printed at the compensation position and the image data to be printed at the adjacent positions and for detecting whether there is image data corresponding to an area to which ink is not ejected among the image data to be printed at the adjacent positions and for swapping and printing at least three pieces of image data to be printed at the compensation position and the adjacent positions according to the ejecting statuses of the nozzles; and a maintenance operation unit for performing a maintenance operation to return the nozzle unit to a printing standby state when the defective nozzle is detected, wherein the three pieces of image data to be printed at the compensation position, and a first and a second position among the image data to be printed of the adjacent positions are swapped for one another according to the ejecting statuses of the nozzles and the analyzed image information, and wherein the first position comprises at least one of an upper position and a lower position, rather than the compensation position, wherein the image data to be printed at the compensation position is shifted to the second position, the image data to be printed at the second position is shifted to the first position, and the image data to be printed at the first position is shifted to the compensation position when image data corresponding to an area to which ink is not ejected is printed at the second position.

14. The apparatus of claim 13, wherein when the image data cannot be swapped for one another, the image data to be printed at the compensation position is divided and printed at the compensation position and the adjacent positions adjacent to the compensation position.

15. The apparatus of claim 13, wherein when the image data cannot be swapped for one another, the image data to be printed at the compensation position is divided and printed at the compensation position and a third position which comprises one of the adjacent positions.

16. The apparatus of claim 15, wherein the image data to be printed at the third position comprises image data corresponding to an area to which ink is not ejected.

17. The apparatus of claim 16, wherein the image data to be printed at the compensation position is printed by ink ejected from two nozzles.

18. The apparatus of claim 17, wherein ink of the same color ejected from the defective nozzle is printed at the third position and ink of a different color is printed at the compensation position.

19. The apparatus of claim 13, wherein when the image data cannot be swapped for one another, image data to be printed at the compensation position is divided and printed at the compensation position and the adjacent positions adjacent to the compensation position.

20. The apparatus of claim 13, wherein when the image data are swapped for one another, driving data are swapped and transmitted to respective nozzles of the nozzle unit.

21. The apparatus of claim 13, wherein the adjacent positions of the compensation position comprises an upper position, a lower position, a left position, a left upper position, a left lower position, a right position, a right upper position, and a right lower position.

22. The apparatus of claim 13, wherein the nozzle unit comprises a length corresponding to a width of a printing medium.

23. The apparatus of claim 13, wherein the defective nozzle detecting unit detects a defective nozzle of the nozzle unit after performing the maintenance operation.

* * * * *